United States Patent [19]

Amburgey

[11] 4,183,527

[45] Jan. 15, 1980

[54] GYROSTABILIZED BOWLING BALL

[76] Inventor: Jay D. Amburgey, 1710 N. Dotsy, Odessa, Tex. 79762

[21] Appl. No.: 953,683

[22] Filed: Oct. 23, 1978

[51] Int. Cl.[2] ..... A63B 37/10

[52] U.S. Cl. ..... 273/63 E; 273/DIG. 20

[58] Field of Search ..... 273/63 R, 63 C, 63 D, 273/63 E, 58 A, 63 G, 128 A; 40/327

[56] References Cited

U.S. PATENT DOCUMENTS

| | | | |
|---|---|---|---|
| 863,126 | 8/1907 | Wilson | 273/63 E |
| 2,291,738 | 8/1942 | Luth et al. | 273/63 E |
| 3,318,598 | 5/1967 | Ruskin | 273/63 C |
| 3,865,369 | 2/1975 | Randolph | 273/63 E |
| 4,121,828 | 10/1978 | Amburgey | 273/63 C X |

FOREIGN PATENT DOCUMENTS

| | | | |
|---|---|---|---|
| 20863 | of 1911 | United Kingdom | 273/63 E |
| 26401 | of 1913 | United Kingdom | 273/63 D |

*Primary Examiner*—George J. Marlo
*Attorney, Agent, or Firm*—Marcus L. Bates

[57] ABSTRACT

A bowling ball which complies with the American Bowling Congress rules and which has the weight thereof distributed in such a manner that when the ball is rolled, the weight distribution produces a gyroscopic effect. The bowling ball has a segmented, light weight core. Two opposed segments are removed from an otherwise spherical core, and another segment positioned normal to the opposed segments is removed from the core. The third segment is replaced with a segment of relatively high density material to form a top weight which offsets the loss in weight occasioned by the subsequent drilling of finger holes. The core is centrally located within the ball and the main body of the ball is made of medium density material so that the main body material which fills the void provided by the two opposed segments provide two parallel arranged weights of medium density. Indicia is provided on the surface of the ball related to the location of the top weight and the stabilizing weights so that the finger holes can be drilled in such a manner that when the ball is released by a player, the ball travels to describe a rolling plane which is parallel to the base of the segments formed by the removal of the two opposed core segments. This provides a gyroscopic effect which stabilizes the ball as it rolls down the bowling lane.

10 Claims, 6 Drawing Figures

GYROSTABILIZED BOWLING BALL

RELATED PATENT APPLICATIONS

My co-pending patent application Ser. No. 649,054 filed Jan. 14, 1976, now U.S. Pat. No. 4,121,828, issued Oct. 24, 1978.

BACKGROUND OF THE INVENTION

In order for one to compete in all bowling meets, it is necessary to use a solid bowling ball fabricated from non-metallic material. The ball must be 27 inches in circumference and must be machined into a preferably spherical geometrical configuration. A top weight must be located in proximity of the finger holes so that the loss in weight from the drilling of the finger holes results in a ball having equal weight distribution within the limits specified by the ABC Rules. The weight of the ball must be between 10–16 pounds. When the ball is weighed with the finger holes "looking-up" and the thumb hole is positioned adjacent to the weigher, the imbalance to the left and right and fore and aft must be no more than 1 ounce and the imbalance between the top and bottom must be no more than 3 ounces. Accordingly, there are very few expedients which can be employed in order to enhance the gyroscopic effect produced by the ball as it rolls down the bowling lane towards the bowling pins.

Others have attempted to provide a gyroscopically stabilized bowling ball, as for example, Randolph U.S. Pat. No. 3,865,369 provides a weighted insert located near the top side of the mid-plane of the ball which provides a dual function of a top weight and a means by which the ball is gyrostabilized. Luth, U.S. Pat. No. 2,291,738 provides a bowling ball having an inner core arranged to maintain the ball in correct balance by the provision of an annular or toroidal centrally located member of heavier material.

Bowling balls must be made in various different weights according to the purchasers' demand. At the same time, the top weight must be varied in order that different size finger holes may be formed within the ball while at the same time the ABC Rules are satisfied. There can be no discernible metal in the bowling ball and the ball must be of solid construction. Therefore, in order to maintain a constant diameter, provide a top weight, and at the same time provide balls which vary in weight from 10–16 pounds, the selection of the materials of construction must be relied upon in order to obtain a specific gross weight. This can be achieved by surrounding a relatively light weight core with a heavier main body, and additionally providing a still more dense top weight which is calculated to offset the loss in weight resulting from the drilling of the finger holes.

In my previous U.S. Pat. No. 4,121,828, there is taught a bowling ball having a top weight arranged in a configuration which effects a gyroscopic action when the ball is rolled. The present invention provides a ball having a light weight core arranged in such a manner that the resultant main body is of a geometrical configuration which effects a gyroscopic action when the ball is rolled.

SUMMARY OF THE INVENTION

A solid bowling ball which apparently is substantially equal in weight about all three axis thereof. The bowling ball has a core of relatively low density, and a main body of relatively medium density. Indicia is formed on the outer surface of the ball at a location which describes the vertical axial centerline thereof. A top weight of relative high density is positioned in underlying relationship respective to the indicia and offsets the loss in weight resulting from the formation of finger holes. The top weight is part of the core and the core is centrally located within the main body. The outer surface of the core is spaced from the outer surface of the main body.

The core is a segmented sphere having opposed portions of the surface cut off by spaced parallel planes, thereby leaving first and second opposed bases which lie parallel to the vertical axial centerline and to one another.

The top weight is attached to and forms part of the core. The top weight is a segment of a sphere which has a base positioned normal to the bases formed by the first and second opposed segments. The vertical axial centerline intersects the geometrical center of the base of the top weight.

The equatorial plane of the ball intersects the geometrical center thereof and is circumscribed equal distant from the indicia and from the geometrical center of the core. All of the top weight is located above the equatorial plane. The opposed segments are bisected by the equatorial plane.

The removal of the first and second opposed segments provides the main body with first and second opposed, parallel arranged masses of a relatively medium density.

The indicia is formed to indicate the location of the top weight as well as the location and orientation of the first and second bases so that finger holes may be subsequently formed in the main body at said top weight. When the ball is rolled to describe a rolling plane which is parallel to the first and second bases, the first and second opposed parallel masses produce a gyroscopic effect.

Accordingly, a primary object of the present invention is the provision of a bowling ball which has the weight thereof distributed in such a manner that two spaced apart masses produce a gyroscopic effect, while at the same time, the mass of the bowling ball is distributed so that the ball is apparently uniform in weight.

A further object of this invention is the provision of a bowling ball which has a light weight core made into a configuration which causes the weight of the main body to produce a stabilizing gyroscopic effect.

A still further object of this invention is the provision of a bowling ball having a main body and a light weight core arranged respective to one another so that when the bowling ball is in play, the weight distribution of the ball produces a gyroscopic effect along a predetermined rolling plane.

Another and still further object of this invention is the provision of a bowling ball having a light weight core made into a configuration to provide spaced apart parallel weights which tend to produce a gyroscopic effect when the ball is rolled.

An additional object of this invention is the provision of a bowling ball having a light weight core and a more dense main body which jointly cooperates together to provide two spaced apart masses which produce a gyroscopic effect when the ball is rolled, and indicia arranged respective to the spaced apart weights which indicates the location of the two weights.

A still further object of this invention is the provision of a bowling ball having indicia arranged on the outer surface thereof related to the location of a top weight and two spaced apart masses wherein the top weight offsets the loss in weight resulting from the formation of finger holes while the two spaced apart masses produce a gyroscopic effect when the finger holes are properly indexed with respect to the top weight and to the two spaced apart masses.

These and various other objects and advantages of the invention will become readily apparent to those skilled in the art upon reading the following detailed description and claims and by referring to the accompanying drawings.

The above objects are attained in accordance with the present invention by the provision of an apparatus fabricated in a manner substantially as described in the above abstract and summary.

DETAILED DESCRIPTION OF THE PREFERRED EMBODIMENT

In the figures of the drawings, there is disclosed a bowling ball 10 made in accordance with the present invention. The bowling ball has an outer peripheral surface 12 in the form of a sphere. Finger holes 14, 16, and 18 are formed into the ball and are of a size and geometry depending upon the size of one's fingers and hand. The finger holes are orientated respective to the ball so that when the ball is released from one's fingers, the ball rolls along a particular predetermined plane. Numerals 14 and 16 indicate the holes which accommodate two fingers of one's hand while numeral 18 indicates the location of the thumb hole, although the holes 14–18 will generally be referred hereinafter as "the finger holes".

Figure 1:
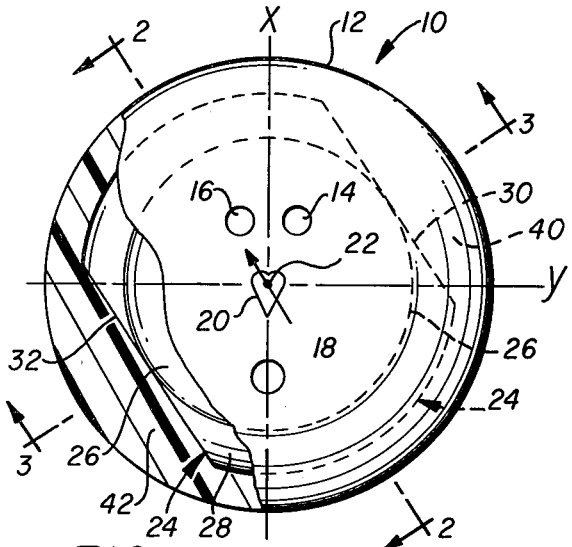
FIG. 1 is a top plan view of a bowling ball made in accordance with the present invention, with some parts being broken away therefrom in order to disclose the interior thereof, and some of the remaining parts being shown in cross-section.

As seen in FIG. 1, indicia 20, which can take on a number of different forms, is formed on the surface of the ball to indicate the vertical central axis of the ball as well as the location of various weight members located within and forming a part of the ball, as will be appreciated later on as this disclosure is more fully digested.

Figure 2:
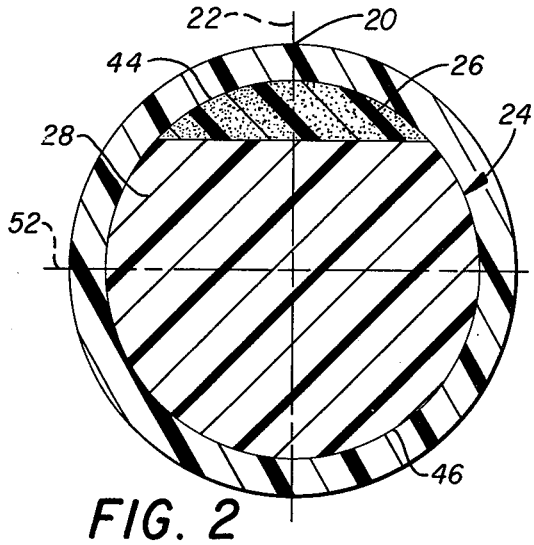
FIG. 2 is a cross-sectional view taken along line 2—2 of FIG. 1.
Figure 3:
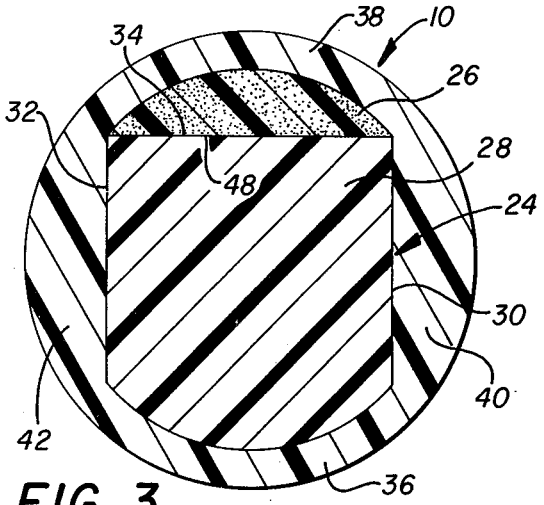
FIG. 3 is a cross-sectional view taken along line 3—3 of FIG. 1.
Figure 4:
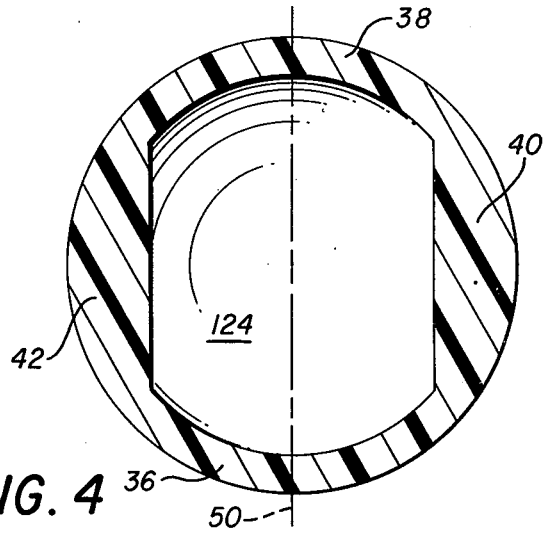
FIG. 4 is a cross-sectional view as seen in FIG. 3, with some parts thereof being removed therefrom.
Figure 5:
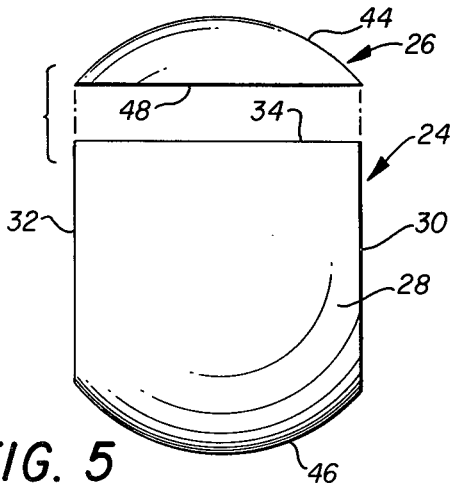
FIG. 5 is a disassembled view of some parts of the bowling ball seen in FIG. 1; and, FIG. 6 is a side elevational view of the bowling ball seen in FIG. 1, with some parts being removed therefrom and some of the remaining parts being shown in cross-section.
Figure 6:
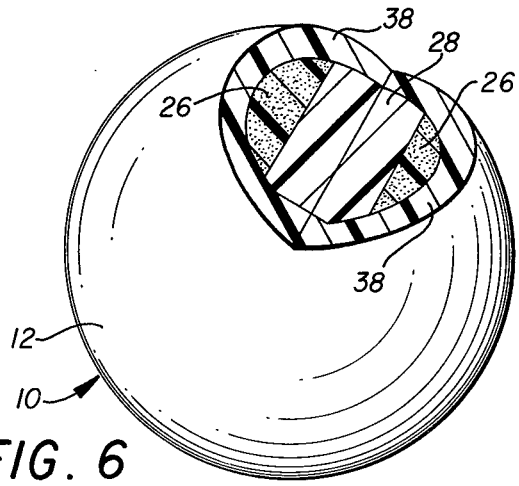

The ball includes a core member 24. A lenticular shaped top weight 26 forms part of the core. As best seen in FIGS. 2, 3, and 5, the core member 24 is segmented to provide a relatively light weight core 28. The segmentation of the core provides bases 30, 32, and 34. Segmented bases 30 and 32 are formed by a portion of the surface of the spherical core member being cut off by a plane, with the planes at 30 and 32 being parallel to one another and diametrically opposed to one another. The base 34 is formed by a portion of the surface of the sphere being cut off by a plane which lines normal to the bases 30 and 32.

The core member, comprised of the segmented member 30 and the top weight 26, provides an annular thin area 36 and 38 of constant thickness about an upper and lower marginal circumference of the ball. The removed segments which form bases 30 and 32 provide a mass at 40 and 42 for the reason that the light weight segments which have been removed to form the two opposed bases have been replaced by the relative dense material which forms the main body. Accordingly, as seen in FIGS. 2, 3, and 5, the core has a constant diameter in one vertical plane which is formed by the outer extremity of the top weight at 44 and the lower extremity at 46. These constant diameter portions 44 and 46 extend from one base 30 to the other base 32. The plane taken normal to the constant diameter part of the core provides a geometrical core figure which is a square having a circular segment at opposed ends.

The interface between the top weight and the segmented core member is indicated by numeral 34 in FIG. 3, for example, and should the top weight be removed from the segmented core member, two similar bases 34 and 48 would result, although the top weight is preferably affixed to and forms an integral part of the segmented core member.

The rolling plane 50 of the ball is parallel to the bases 30 and 32 of the segmented member. The rolling plane of the ball is also parallel to the arrow which intersects the vertical axis 22 of FIG. 1. Accordingly, the indicia 20 indicates the vertical axis of the ball as well as the rolling plane of the ball and the orientation of the two masses 40 and 42.

As seen in FIG. 2, the equatorial plane 52 of the ball is placed normal to the vertical axis 22 as well as to the opposed bases 30 and 32.

The ball is manufactured by pouring relatively dense plastic resin material into a suitable Teflon (TM) mold to form the top weight. The material from which the top weight is formed preferably is epoxy resin to which finely divided Barium has been admixed in order to provide a relatively high density material. The light weight core 28 is formed by pouring a relatively light weight material into a mold having a cavity formed therein which provides the geometrical configuration illustrated by numeral 28 in FIG. 5, for example the relatively light weight core material is attained by admixing micro-ballons with epoxy resin or the like.

After the entire core assembly has cured, it is suspended within a mold having a spherical cavity and plastic resin of medium density fills the void between the core assembly and the inner wall surface of the mold, thereby forming the main body of the bowling ball. The entire assembly is removed from the mold and indicia is placed on the outer surface of the main body in the manner of FIG. 1 so as to positively locate the geometrical center of the top weight as well as the location of the two spaced apart gyroscopic producing masses, 40 and 42.

When forming the finger holes 14, 16, and 18, the holes must be drilled such that they are orientated respective to the opposed weights 40 and 42 so that when the ball is released, the ball rolls down the lane to describe a rolling plane 50.

The core member preferably is spaced $\frac{1}{2}$ to $\frac{3}{4}$ inches from the surface of the ball at 36, 38 and 1 to $2\frac{3}{4}$ inches at bases 30, 32, depending upon the final desired weight of the ball and the density of the core member 28.

The topweight can vary from ½ to 2 inches in thickness and from 1 to 5 ounces in weight depending upon the proposed size of the finger holes and the density of the plastic material used to form the top weight.

The final weight of the ball is 10 to 16 pounds, the circumference 27 inches, and the ball must ballance within 1 ounce to either side of the X axis and 3 ounce on either side of the equatorial plane.

I claim:

1. A solid bowling ball having a core of relatively low density, a main body of a relatively medium density; means forming indicia on the outer surface of said ball at a location which describes the vertical axial centerline of said ball, a top weight of relatively high density; said top weight being positioned in underlying relationship respective to said indicia and offsetting the loss in weight resulting from the subsequent formation of finger holes;

said core being centrally located within said main body and having an outer surface which is spaced from the outer surface of said main body so that the entire core is located within said main body;

said core being a segmented sphere wherein opposed portions of the surface of the core are cut off by spaced parallel planes to leave first and second opposed bases which lie parallel to said vertical axial centerline;

said top weight is attached to and forms part of said core, said top weight is a segment of a sphere which has a base positioned normal to said first and second opposed bases; said vertical axial centerline intersects the geometrical center of said base of said top weight;

the equatorial plane of the ball intersects the geometrical center thereof and is circumscribed equidistant from said indicia and from the geometrical center of said core; all of said top weight being located above said equatorial plane;

said first and second opposed bases provide the main body with first and second opposed masses of a relatively medium density; said indicia being formed to indicate the location of said top weight and the location of said first and second bases whereby finger holes may be formed in said main body at said top weight so that when the ball is rolled to describe a rolling plane which is parallel to said first and second bases, the first and second opposed masses produce a gyroscopic effect.

2. The ball of claim 1 wherein finger holes are formed asymmetrically respective to said rolling plane and symmetrically respective to said indicia such that the indicia lies between the two finger holes and the thumb hole of said finger holes, while the rolling plane lies 30° to 60° respective to a line which bisects the thumb hole and extends between the finger holes.

3. The ball of claim 2 wherein said ball is 27 inches in circumference and has a gross weight of 10 to 16 pounds, said top weight is 1 to 5 ounces, and said core is 7 to 8 inches in diameter.

4. The ball of claim 3 wherein said top weight has a base which is 2 to 6 inches in diameter and is ½ to 2 inches in thickness.

5. The ball of claim 4 wherein said main body is made of plastic resin, said core is made of plastic resin admixed with micro balloons, and said top weight is made of plastic resin admixed with Barium.

6. The ball of claim 5 wherein said first base and said second base are 4½ to 5¼ inches diameter, said core is of constant diameter in a plane which extends parallel to said first and second bases.

7. The ball of claim 1 wherein said ball is 27 inches in circumference and has a gross weight of 10 to 16 pounds, said top weight is 1 to 5 ounces, and said core is 7 to 8 inches in diameter;

said first base and said second base are 4½ to 5¼ inches diameter, said core is of constant diameter in a plane which extends parallel to said first and second bases.

8. A solid bowling ball having a core member, a main body surrounding said core member, means forming indicia on the outer peripheral surface of said ball at a location which describes the vertical axial centerline of said ball, said core member being centrally located respective to said main body; means forming finger holes into said ball at the location of said indicia;

a top weight of relatively high density which offsets the loss in weight from the formation of said finger holes, said top weight being located in underlying relationship respective to said indicia, said top weight forms the marginal end of the core member which is located nearest adjacent to said indicia;

means forming said core member into a segmented sphere having opposed truncated sides said opposed sides are arranged parallel and spaced from one another and have an outer perimeter which describe a plane which lies normal to the equatorial plane of the ball;

said indicia indicates the orientation of the parallel sides and the center of the mass of said top weight, said finger holes are orientated respective to the parallel sides so that the ball, when rolled, describes a rolling plane which is parallel to the parallel sides;

the truncation of said core causes the weight distribution of the main body to form opposed masses so that a greater concentration of weight is located in spaced parallel planes which are parallel to the rolling plane of the ball, thereby effecting a gyroscopic effect when the ball is rolling along the rolling axis thereof.

9. The ball of claim 8 wherein finger holes are formed asymmetrically respective to said rolling plane and symmetrically respective to said indicia such that the indicia lies between two finger holes and the thumb hole of said finger holes, while the rolling plane lies 30° to 60° respective to a line which bisects the thumb hole and extends between the finger holes.

10. The ball of claim 8 wherein said main body is made of plastic resin, said core is made of plastic resin admixed with micro balloons, and said top weight is made of plastic resin admixed with Barium.

* * * * *